United States Patent [19]

Tajima et al.

[11] Patent Number: 5,056,332

[45] Date of Patent: Oct. 15, 1991

[54] REFRIGERATOR

[75] Inventors: Hiroshi Tajima, Tochigi; Yoshihide Sato, Gunma, both of Japan

[73] Assignee: Sanyo Electric Co., Ltd., Osaka, Japan

[21] Appl. No.: 688,059

[22] Filed: Apr. 19, 1991

[30] Foreign Application Priority Data

Apr. 20, 1990 [JP] Japan ..... 2-106252
Sep. 19, 1990 [JP] Japan ..... 2-250798

[51] Int. Cl.[5] ..... A47F 3/04

[52] U.S. Cl. ..... 62/252; 62/441; 312/116; 312/236

[58] Field of Search ..... 62/252, 441; 312/116, 312/236

[56] References Cited

U.S. PATENT DOCUMENTS 1,434,544 11/1922 Jensen ..... 62/252
2,245,300 6/1941 Ruttan ..... 62/252 X
2,252,237 8/1941 Stiles ..... 62/252
2,638,400 5/1953 Spotts .
2,869,331 1/1959 Koon ..... 62/441 X
3,010,291 11/1961 Sanders et al. ..... 62/252

FOREIGN PATENT DOCUMENTS 57-21991 2/1982 Japan .
60-33224 8/1985 Japan .

*Primary Examiner*—Lloyd L. King
*Attorney, Agent, or Firm*—Darby & Darby

[57] ABSTRACT

A refrigerator including: storage chambers formed inside a thermal insulation box having generally rectangular horizontal cross section, said chambers having a duct provided at one rear corner of respective chamber for communication with the rear space behind the storage chambers where cold air is generated by a heat exchanger of the refrigeration unit; rotatable round shelves in the storage chambers; a lamp provided at the other rear corner of the storage chamber; and door pockets provided on the inner surface of the doors, said door pockets extending to front corner space in the storage chambers.

9 Claims, 12 Drawing Sheets

REFRIGERATOR

FIELD OF THE INVENTION

The invention relates to a type of refrigerators which refrigerate the storage chambers inside thereof by circulating cold air generated by a heat exchanger of a refrigerating unit by means of a blower.

BACKGROUND OF THE INVENTION

Conventional refrigerators of this type have an upright refrigeration unit in a rear portion behind a freezer chamber, as disclosed in Japanese Patent Publication No. 60-33224, and a blower above the refrigeration unit for sucking the cold from the refrigeration unit and blowing it in part from an outlet port to the freezer chamber. The cold air blown into the freezer chamber is collected into an air intake port provided in the front portion of the freezer chamber and returned from there back to the rear portion through a return channel. The other part of the cold air is once led by the blower to the right of the rear portion, avoiding the refrigeration unit, and then led down to the refrigeration chamber.

However, such an air intake port in the freezer chamber mentioned above appears instantly in the front portion of the chamber as the freezer door is opened, which gives not only poor looking but also low refrigeration efficiency by sucking the cold air directly from the outlet port to the inlet port, rather than circulating the cold air throughout the freezer chamber. This tends to prevent uniform freezing, particularly in the upper portion, front portion, and rear portion of the freezer chamber. On the other hand the cold air released into the refrigeration chamber loses its fluid velocity due to turbulence caused by friction through a long detour in the rear portion, failing to cool the refrigeration chamber efficiently.

Conventional refrigerators have their cold air ducts disposed in the central portion of the refrigeration chamber. Since these ducts require a large space behind the refrigeration chamber, they limit the size of the refrigeration chamber.

Conventional refrigerators have another problem that those foods placed on the shelves deep in the freezer and refrigeration chambers are difficult to reach, so that they are often left there till they are rotten.

BRIEF DESCRIPTION OF THE INVENTION

The invention is directed to solve these problems mentioned above. It is therefore an object of the invention to provide a refrigerator which is capable of uniformly refrigerating goods in the storage chambers by uniformly circulating cold air therein.

It is another object of the invention to provide a refrigerator which permits easy access to any goods placed in the refrigerator.

A refrigerator according to the invention, has a thermal insulation box which is generally rectangular in horizontal cross section and a storage chamber inside the thermal insulating box, and includes rotatable and generally round shelves in the storage chamber and cold air passages formed in a region outside the shelves but within the thermal insulation box and communicating with the storage chamber.

Such round shelves permit efficient utilization of otherwise non-usable dead corners of the storage chamber, because, firstly, the round shelves provides excellent cold air feeding mechanism along the corners, of the storage chamber, and secondly they may provide extra space for goods by extending deeply into the rear portion of the refrigerator, in a manner explained in detail below.

A cold air passage may be provided in one corner and a lamp in another corner of the storage chamber. Since such a cold air passage extends along the corner, it will provide efficient cold air circulation, which is suitable for feeding cold air uniformly in the storage chamber. Since a long lamp shade extends along the corner, it will provide uniform illumination on the entire shelves.

It is recommended to provide the refrigerator with doors which are outwardly curved so as to fit to the extending portion of said shelves when the doors are closed. It is convenient to provide the doors with door pockets extending inwardly to the front space between the shelves and the doors.

The above mentioned configurations of the doors and the door pockets permit, without any influence to the smooth circulation of the cold air, efficient utilization of the otherwise dead corner spaces between the doors and the round shelves, adding extra preservation area to the pockets. Therefore, practically no dead space remains in the refrigerator even when round shelves are employed for a generally rectangular cross sectional thermalinsulation box. This is an important feature, since the combination of rotatable shelves and a rectangular cross sectional thermal insulation box meets two desirable requirements for convenience in food storage and convenience in installation of a refrigerator in a room.

Therefore, a refrigerator having a thermal insulation box, a storage chamber defined in said thermal insulation box, and a partition member for partitioning the storage chamber into smaller chambers at different levels, and constructed in accordance with the invention has another feature that the refrigerator comprises: a heat exchanger of the refrigerating unit which is disposed behind the storage chambers in inclination to the vertical line; a blower disposed at a corner of said rear space and at the exit side of said air passage of the heat exchanger of the refrigerating unit; a cold air outlet port provided at one rear corner of the storage chamber and a cold air intake port at the other rear corner for said storage chamber to communicate with said rear space.

In conventional refrigerators a heat exchanger of the refrigerating unit is disposed in the rear of a freezer chamber with its air passage extending in a vertical direction to obtain sufficient path length required for desired heat exchange, and is provided with a blower mounted above the heat exchanger of the refrigerating unit. It is therefore difficult to significantly decrease the height of the freezer chamber. In contrast, the heat exchanger of the refrigerating unit of this invention is inclined as mentioned above and has a cold air blower disposed at one corner of the rear space and at the exit of the air passage of the heat exchanger of the refrigerating unit. This arrangement of the heat exchanger of the refrigerating unit and the blower requires much smaller space than conventional ones, so that the freezer chamber above the partition member may have correspondingly smaller height. Furthermore, the inclination of the heat exchanger of the refrigerating unit, and hence the inclination of the cold air passage through the heat exchanger of the refrigerating unit, supports smooth flow of the cold air through the freezer chamber i.e. from the outlet port to the intake port of the chamber, thereby removing stagnation of the cold air in the corners of the chamber and providing improved refrigeration efficiency.

The shelves provided in the storage chamber are preferably in the form of plate and rotatable.

Such shelves provide easy access to goods deep in the storage chamber without extending arms there. They may be reached by simply rotating the shelves.

It is desirable to provide the storage chamber with shelves and a cold air outlet port to each space partitioned by the shelves.

Such cold air outlet ports may establish not only uniform circulation of the cold air in the refrigeration chamber and hence improved refrigeration therein, but also independent circulation of cold air in respective spaces, thereby permitting refrigeration of goods on one shelf without being affected by goods on the other shelves.

The shelves may extend outwardly of the front opening of said thermal insulation box. In this case the doors for the thermal insulation box may be curved outwardly so as to fit the extending portion of the shelves.

Such configuration of the doors allows use of enlarged rotational shelves and thus enlarged storage area while minimizing the proportion of the "dead spaces" formed between the rotatable shelves and the side walls of the thermal insulation box.

The partition member may be also extended out of the front opening of the thermal insulation box. This also helps increase storage area in the chamber above, and eliminates necessity of thick doors for the storage chamber. Therefore, light doors may be used. Light doors add durability to the door attachments and hence relax some design requirements.

It is desirable to configure the front edge of the partition member to include end portions having straight outlines and a central portion having an outwardly curved outline having a specified radius of curveture. It is also desirable to configure the fringes of the doors that face said front edge of the partition member to have approximately the same contour as said front edge of the partition member, and provide the doors with seal members on respective inner surfaces that may abut on the front edge of said partitioning member.

Since the inner surface of the doors has such contour as mentioned above which corresponds to the contour of the front edge of the partition member, any ordinary sealmembers may be used with the curved doors, providing air-tight seal. No loss in refrigeration performance or dew deposition inside the storage chamber due to poor sealing will not arises from such curved doors.

DETAILED DESCRIPTION OF THE PREFERRED EMBODIMENT

Figure 1:
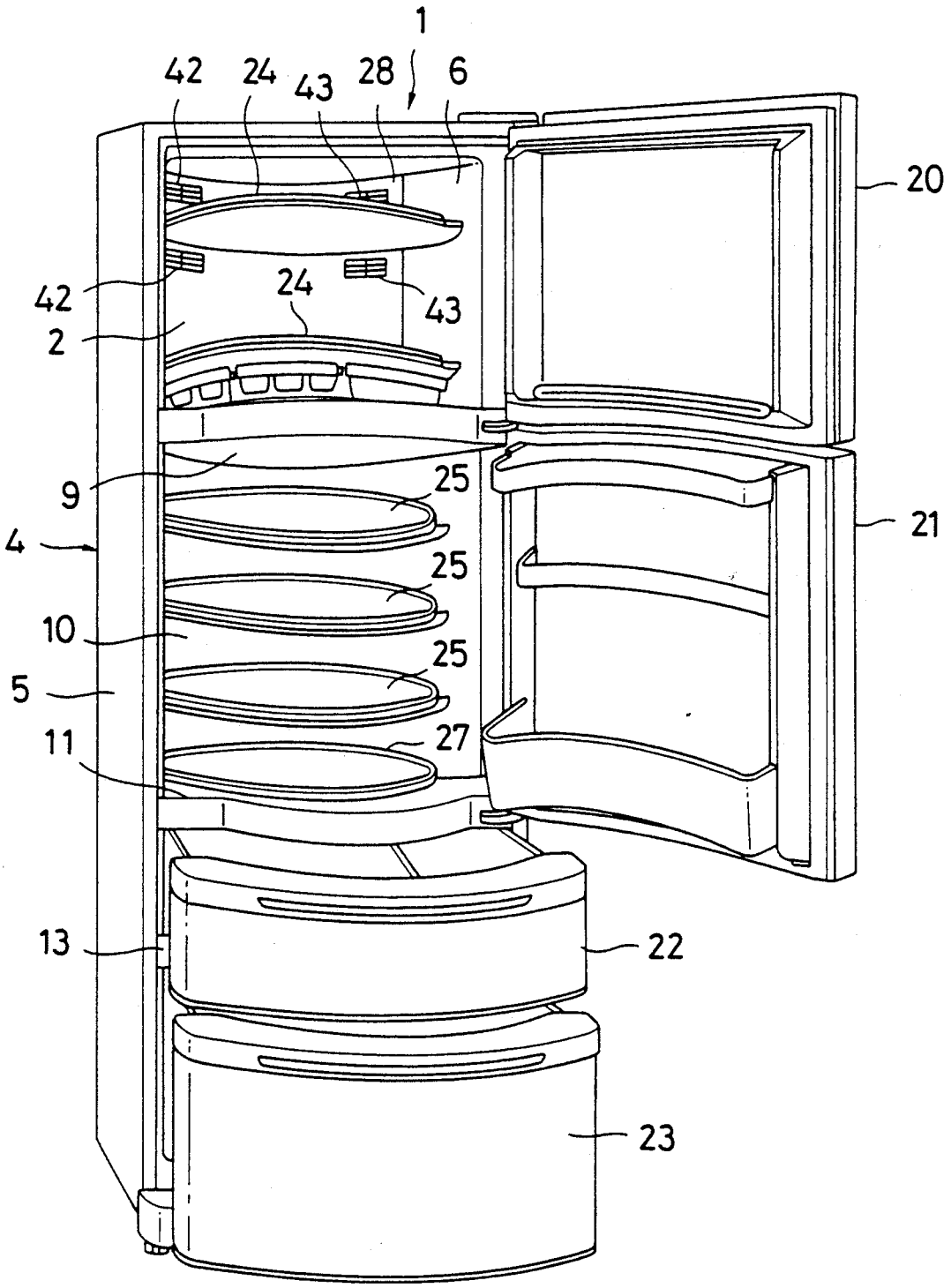
FIG. 1 is a perspective view of a refrigerator embodying the invention.
Figure 2:
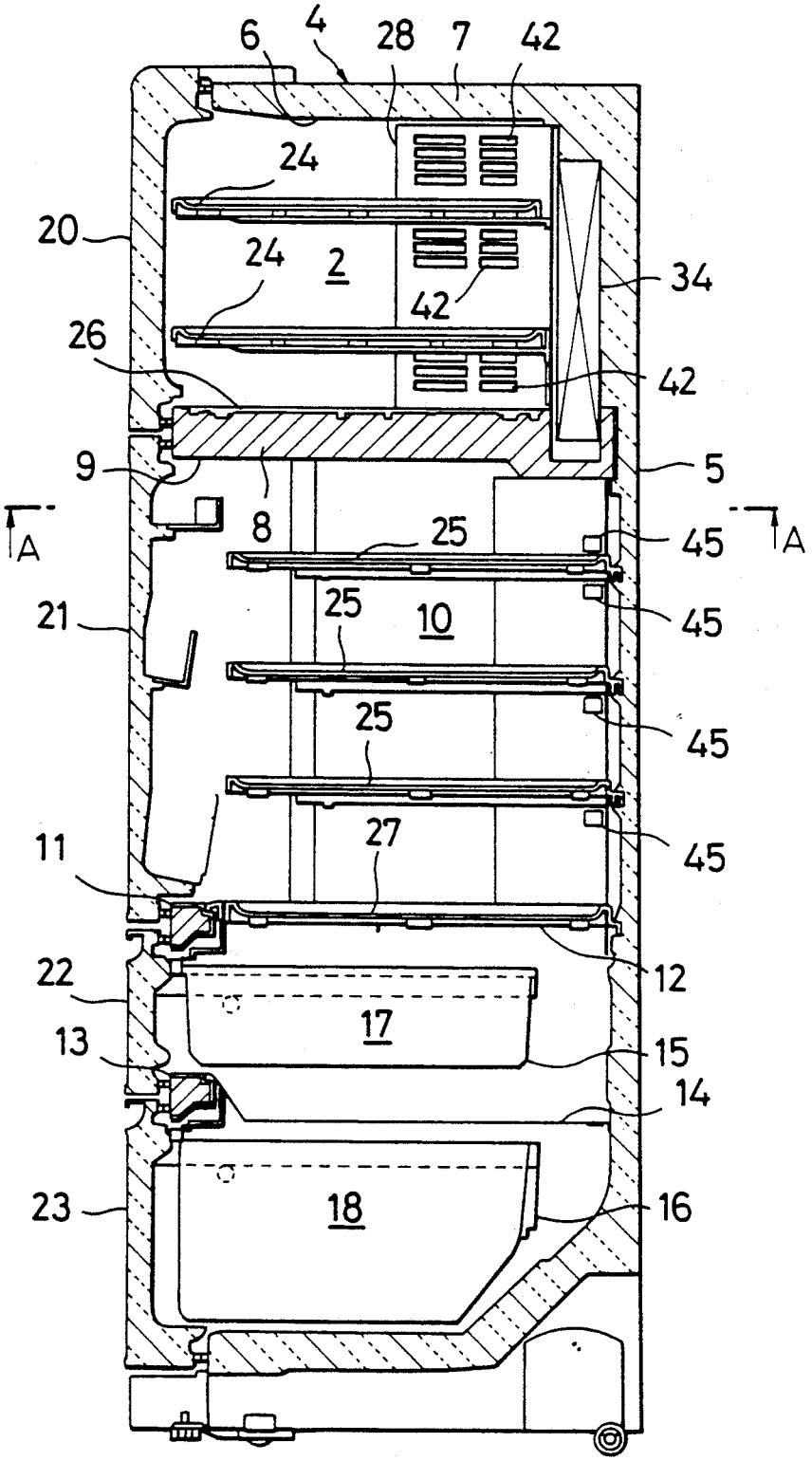
FIG. 2 is a vertical cross section of the refrigerator shown in FIG. 1.
Figure 3:
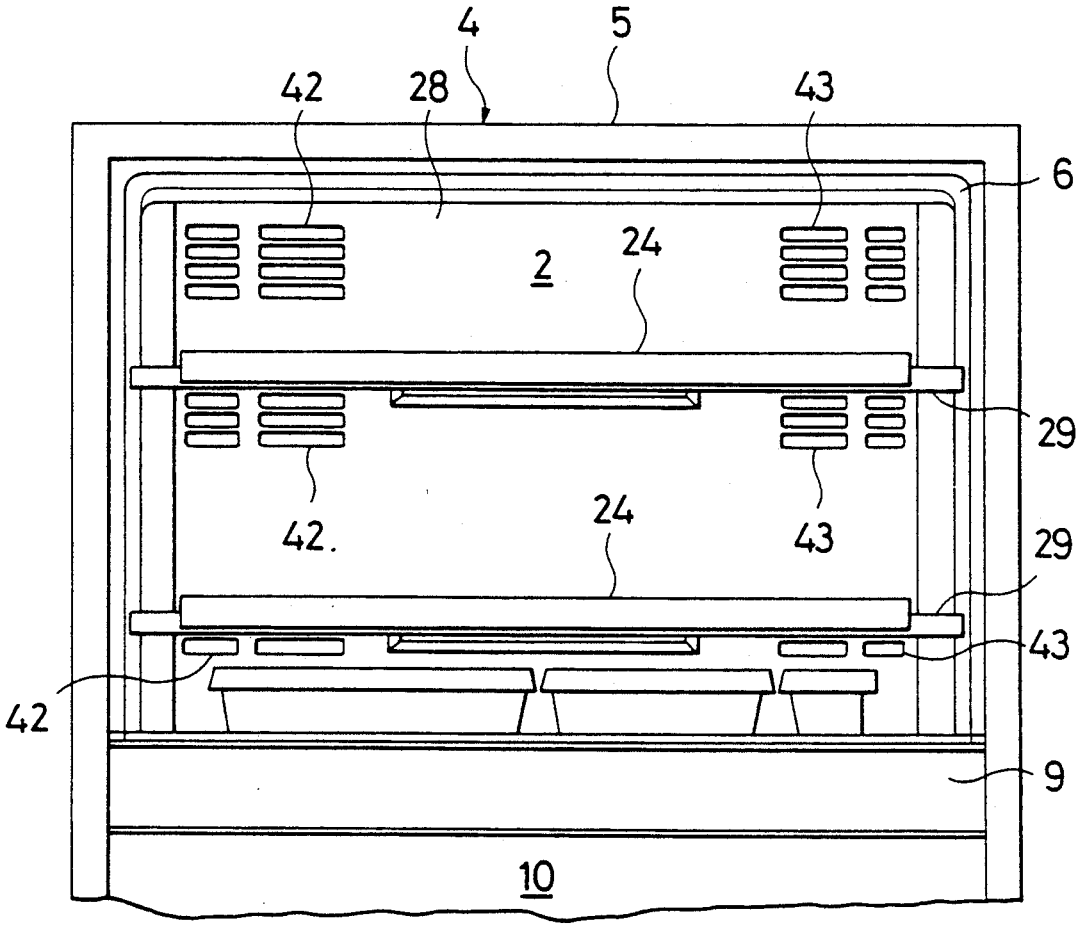
FIG. 3 is a front view of the freezer chamber of the refrigeration shown in FIG. 1.

A thermal insulation box 4 of a refrigerator 1 includes, as shown in FIG. 1, an outer box 5 made of steel, an inner plastic box 6, a expanded material 7 such as polyurethane filling the space between the boxes 5 and 6 for thermal insulation. The thermal insulation box 4 has a storage chamber having a ceiling wall, right and left side walls, a rear wall, and a bottom wall, all made of thermal insulator, and at least one cold air outlet for cold air provided in one of said walls and a front opening. The inner box 6 of the thermal insulation box 4 has a partition member 9 which is filled with a molded thermal insulator made of, e.g. expanded styrol. The inner space of the thermal insulation box 4 is thus divided by the partition member into an upper freezer chamber 2 and a lower refrigeration chamber 10.

Lower portion of the refrigeration chamber 10 is further partitioned by a set of front partition element 11 and partition board 12, and by another set of front partition element 13 and partition board 14, into two smaller spaces i.e. an ice-temperature compartment 17 for accommodating a container 15 having an upper opening and a vegetable compartment 18 for preserving vegetables in a container 16 having an upper opening. There are provided at the front openings of the freezer chamber 2 and the refrigeration chamber 10 a freely rotatable doors 20 and 21, respectively, which are pivotally supported by the side wall of the thermal insulation box 4. Doors 22 and 23 are also provided at the front opening of the ice-temperature compartment 17 and the vegetable preservation compartment 18, respectively, which doors may be freely drawn out of the box 4 together with respective containers 15 and 16. There are provided in the freezer chamber 2 and the refrigeration chamber 10 a plurality of round shelves 24 and 25, respectively, which are made of transparent plastics. The shelves 24 and 25 are made freely rotatable so as to provide easy access to the goods placed thereon deep in the chambers by rotating the shelves. There are also provided on each of the partition member 9 and the partition board 12 similar freely rotatable shelves 26 and 27, respectively.

Figure 4:
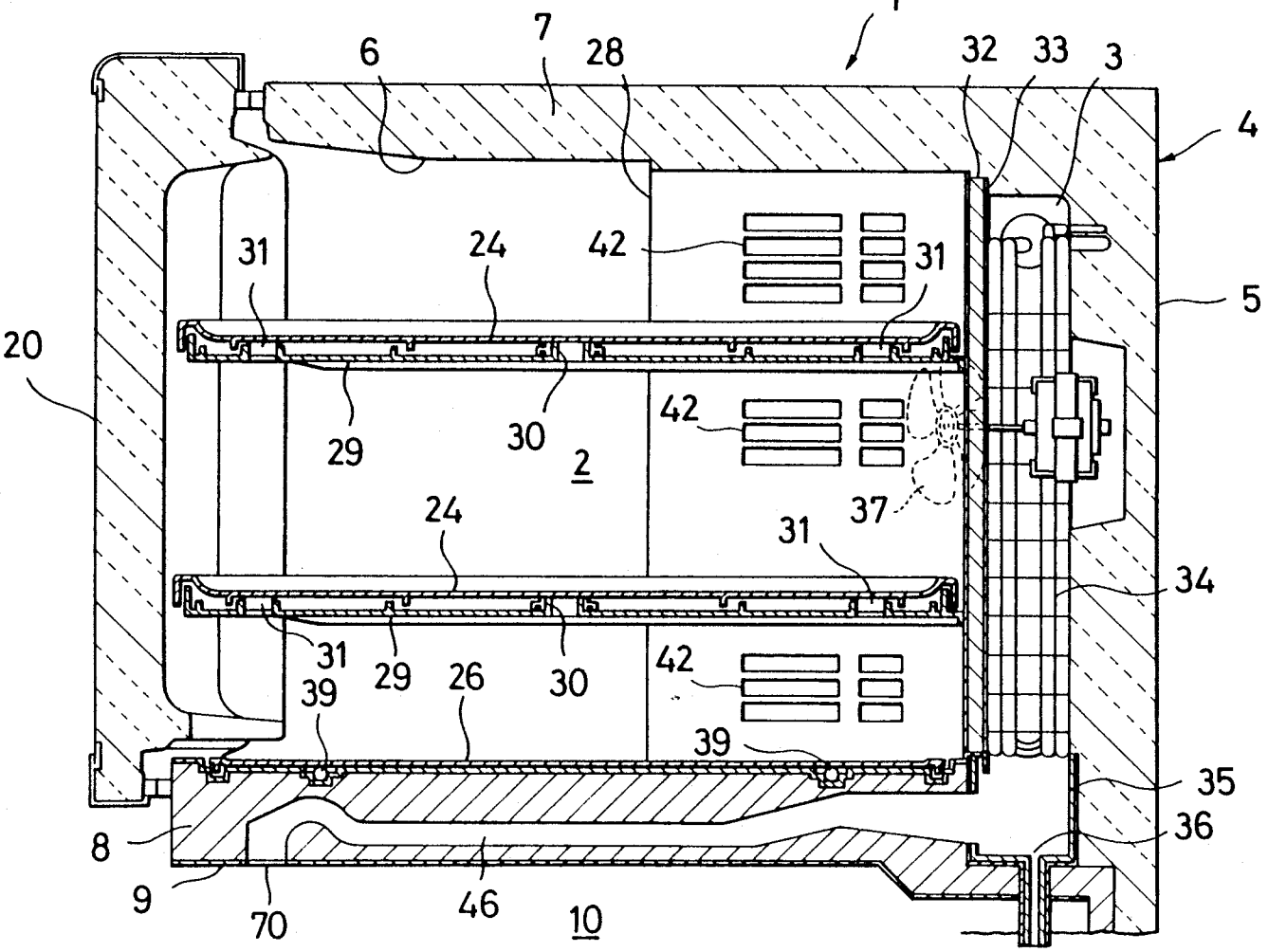
FIG. 4 is a vertical cross section of the freezer chamber of FIG. 3.
Figure 5:
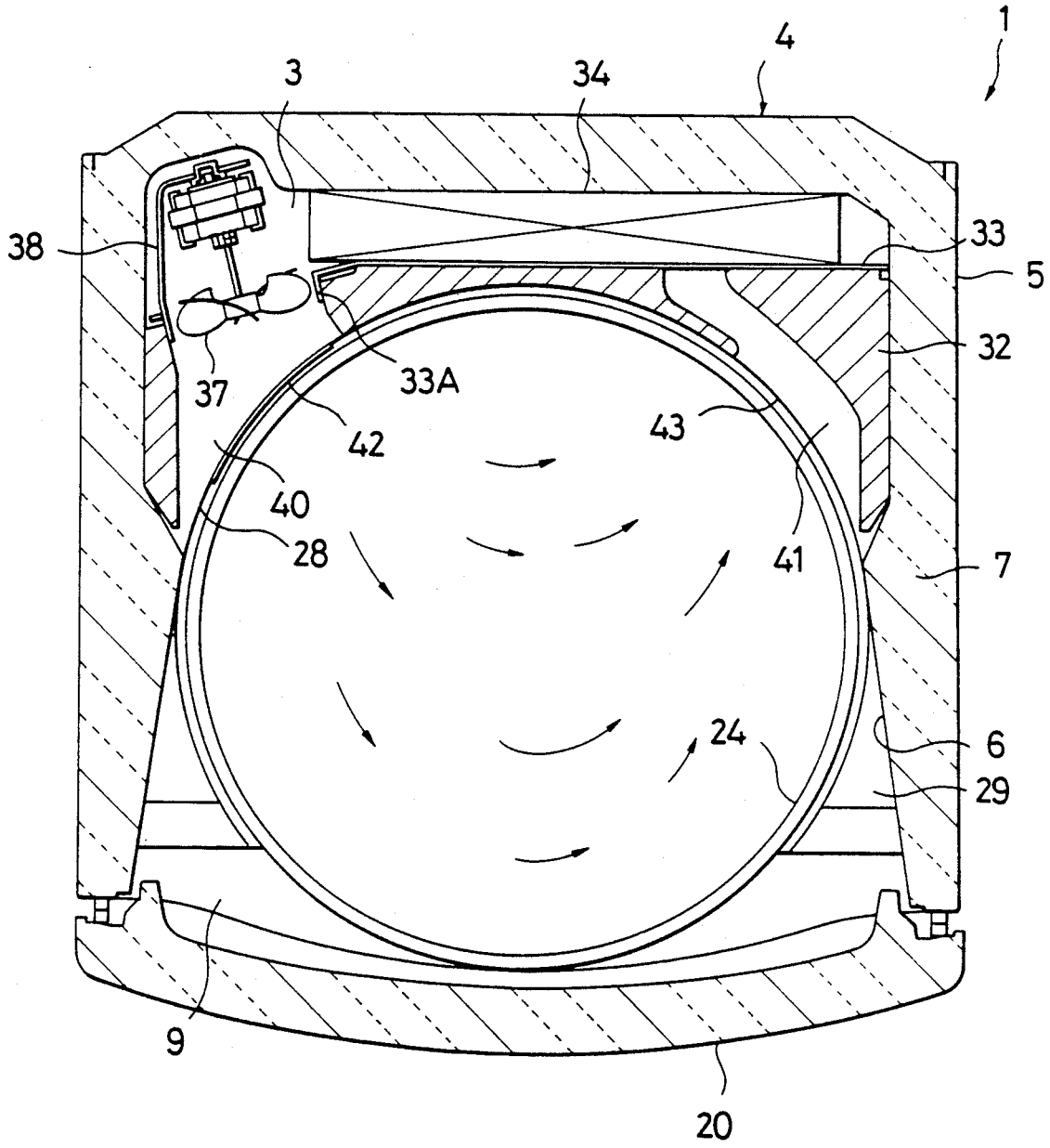
FIG. 5 is a horizontal cross section of the freezer chamber of FIG. 3, taken at a level just above a shelf.

Referring now to FIGS. 4 and 5, the structures of the freezer chamber 2 and pertinent parts are described. The rear portion of the freezer chamber 2 is defined by an arcuate rear panel 28 extending along the rear portions of the shelves 24. The shelves 24 in the freezer chamber are mounted on a transparent plastic support panels 29 which are in turn removably supported by the inner box 6 and the rear panel 28. The shelves 26 are supported by a shaft 30 and rollers 39 sitting on the partition member 9 so that the shelves may be freely rotated about the axis of the shaft 30.

The shelves 24 project their front edges slightly farther than the front end of the opening of the thermal insulation box 4 i.e. the front edge of the outer box 5. The front edge of the partition member 9 is also projecting outwardly in a similar fashion. The inner surface of the door 20 (and of other doors as well) is curved concave in correspondence with the projection of the partition member 9.

Figure 6:
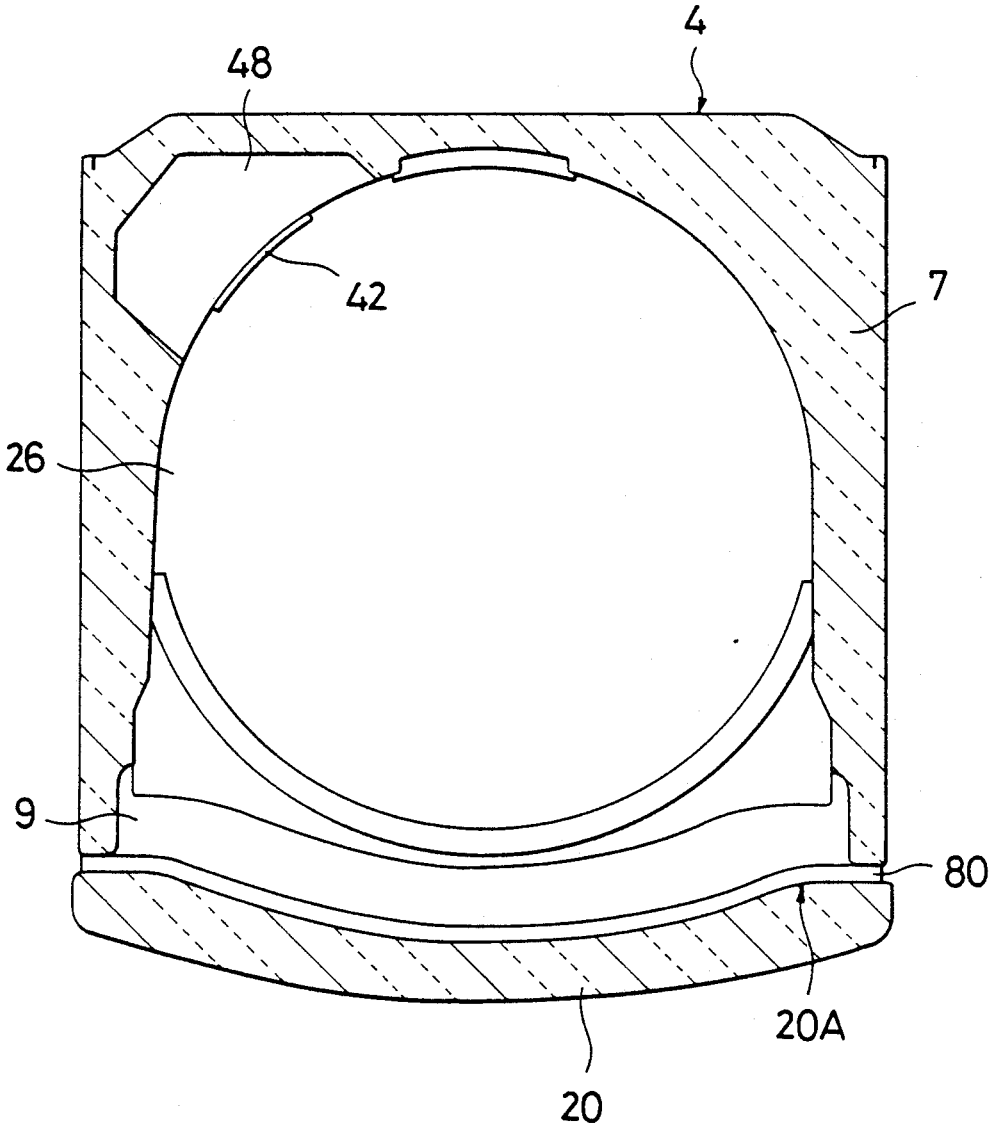
FIG. 6 is a horizontal cross section of the freezer chamber of FIG. 3, taken at a level just above the partition member.

On the periphery of the inner surface of the door 20 is a gasket 80 provided to establish an air-tight space within the freezer chamber. The lower end of the gasket 80 is configured to fit the front curved profile of the partition member 9. Since the front end of the partition member has flat portions as well as central arcuate portion, those portions connecting the curved and straight portions have smaller radius of curvature than the rest. Consequently, a gasket having a uniform thickness will not fit these connecting portions, leaving gaps therebetween, if the inner surface of the door is also curved same as the outer surface thereof. In order to prevent these gaps to occur, the inner surface of the door is designed to "press" the gasket against the partition member, as shown in FIG. 6, whereby the gasket maintains above mentioned air-tight seal.

Figure 7:
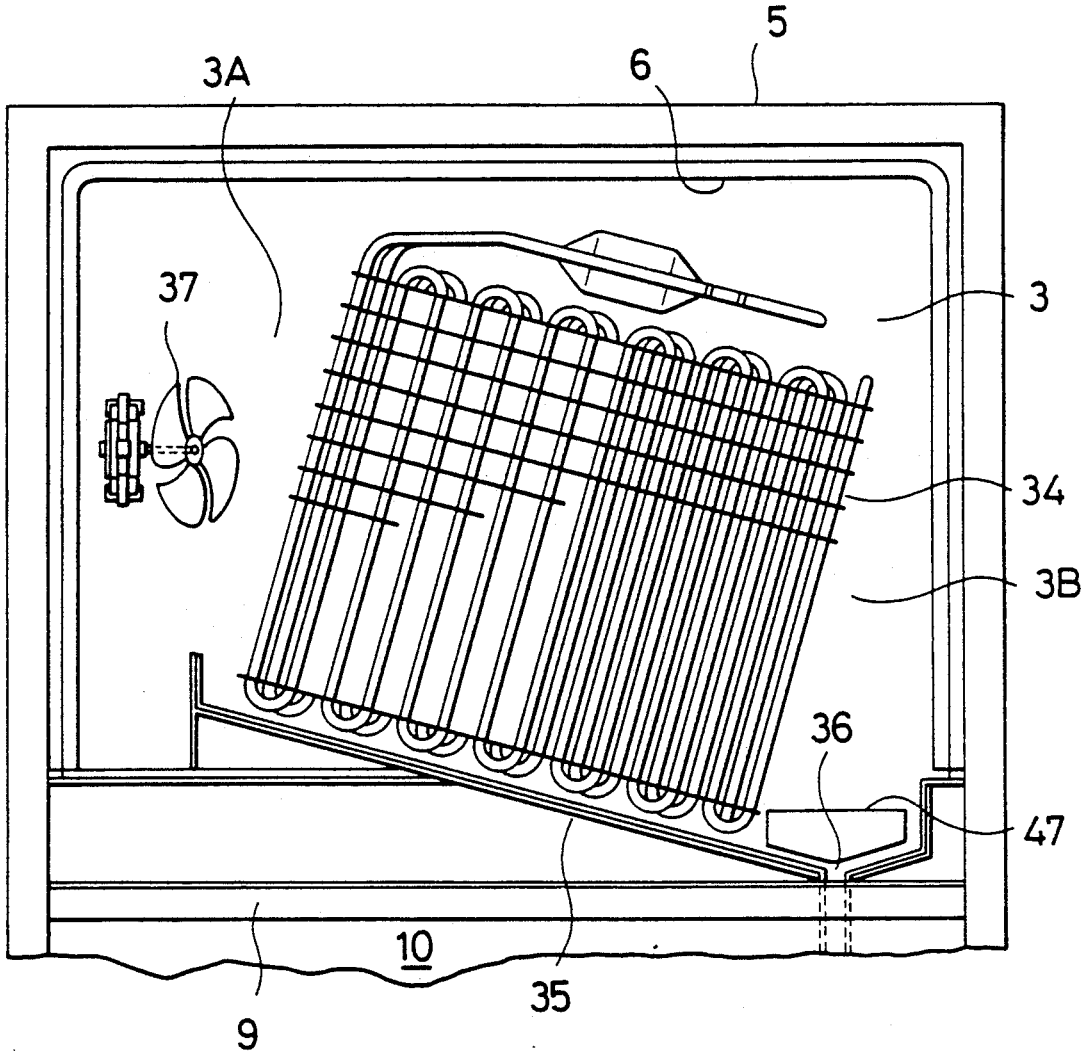
FIG. 7 is a front view of a refrigerator embodying the invention.
Figure 8:
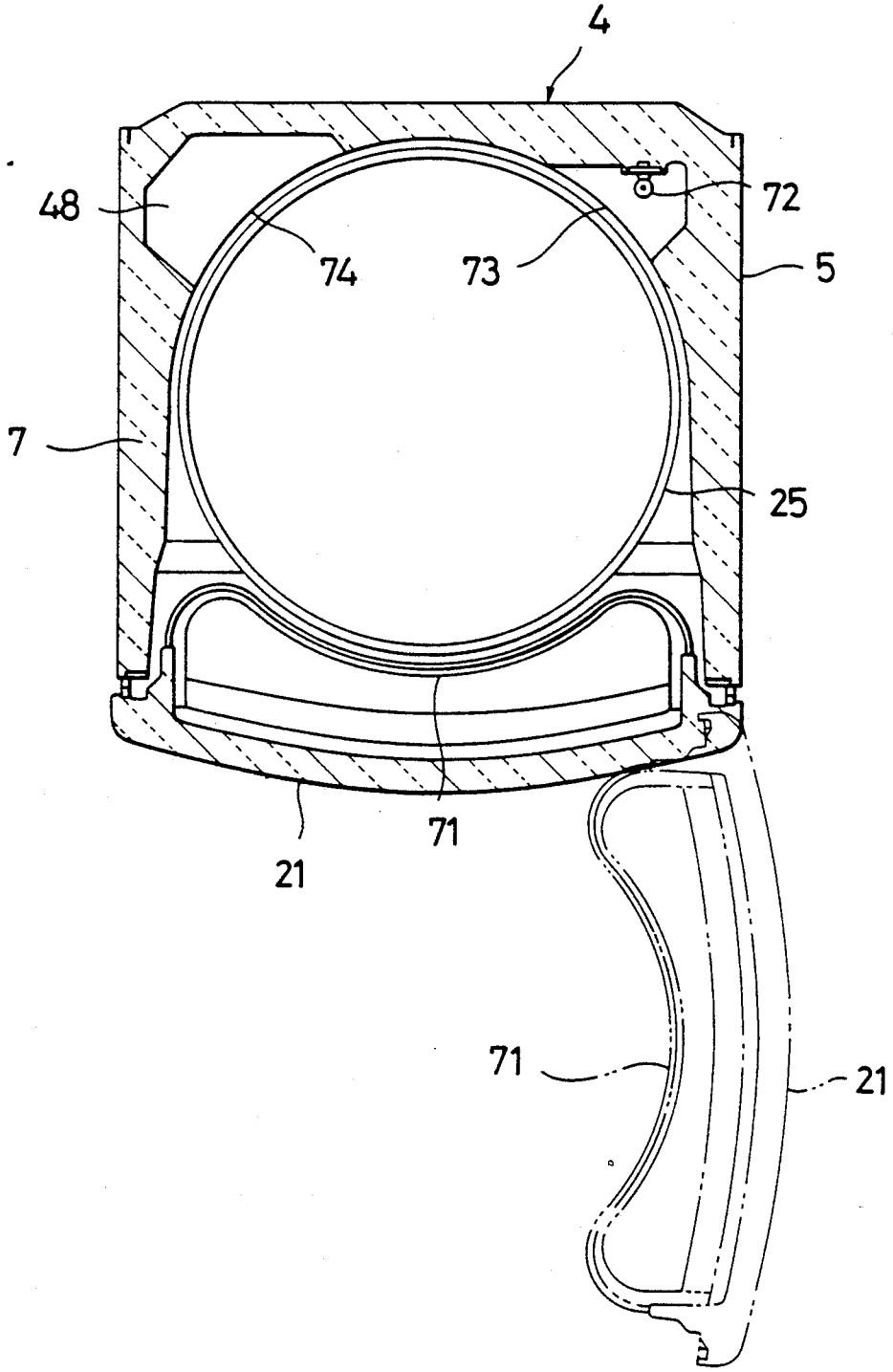
FIG. 8 is a horizontal cross section of a refrigerator embodying the invention.
Figure 9:
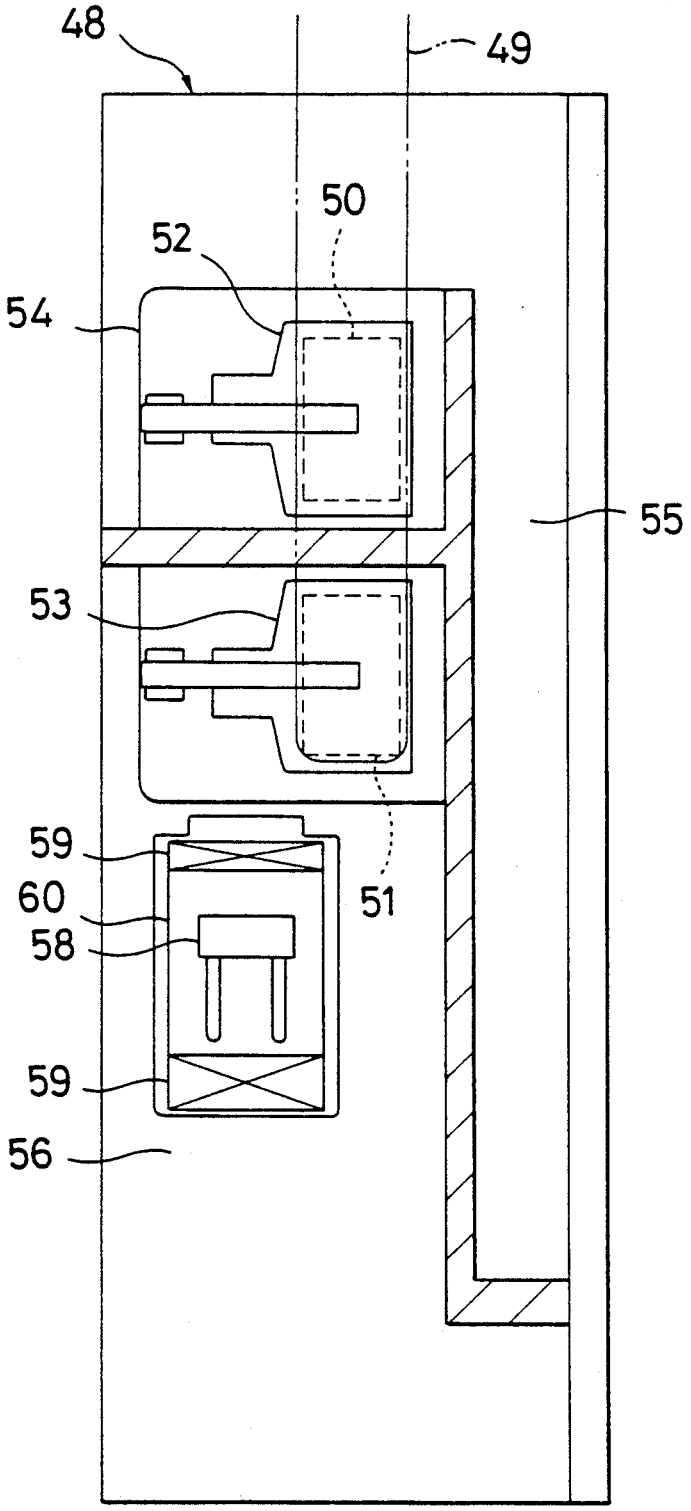
FIG. 9 is a front view of a cold air supply duct of a refrigerator embodying the invention.
Figure 10:
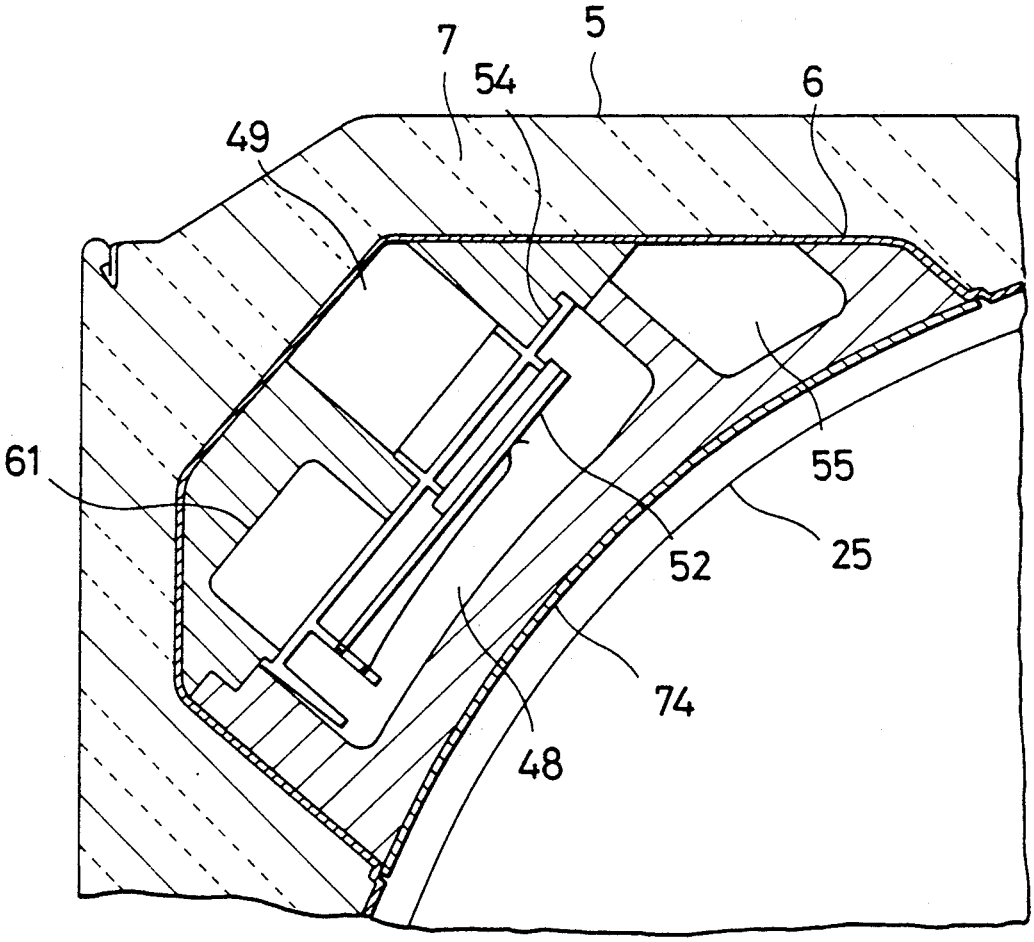
FIG. 10 is a horizontal cross section of plan view a cold air supply duct of a refrigerator embodying the invention.

In back of the panel 28 is a compartment for housing a refrigeration unit 3, the rear of which is defined by a molded thermal insulation member 32 and a partition wall 33. The compartment 3 accommodates major elements of the heat exchanger of the heat exchanger of the refrigerating unit such as an evaporator 34. The evaporator shown in FIG. 6 is a so-called cross fin tube type heat exchanger, which extends generally along the rear wall of the inner box 6 and is inclined towards the left of the refrigerator (in reference to FIG. 7) at an angle of 15° to 30° with respect to a horizontal line. This inclination of the evaporator, and hence the fins thereof, helps defrosted water flows downward on the fins.

Below the evaporator 34 is a dew receiving tray 35 for receiving defrosted water from the fins. The dew receiving tray 35 is also inclined along the lower end of the evaporator 34. Since the evaporator is inclined along the tray 35, it may save a triangular dead space which would be otherwise formed between the upright evaporator 34 and the tray 35.

A fan 37 is mounted on a mounting board 38 at a corner of the compartment 3 closer to a cold air outlet 3A. The fan is oriented towards a fan ring 33A in the partition wall 33, through which cold air is directed towards the front left portion of the refrigerator.

Corner space is formed at opposite ends of the partition wall 33 between shelves and the inner box. This corner space is, however, utilized by a generally vertical cold air discharge duct 40 and a cold air return channel 41 constructed in a molded thermal insulation member 32. The cold air discharge duct 40 communicates with the fan 37 and with the freezer chamber 2 through cold air outlet ports 42 provided in the left corner of the panel 28. The cold air return channel 41 communicates between the freezer chamber 2 through the cold air inlet ports 43 at the right corner of the freezer chamber 2, and with another duct connected with a cold air suction port 3B of the evaporator 34.

The cold air generated by the evaporator 34 is drawn by the fan 37 to the cold air outlet port 3A in the left corner (in reference to FIG. 7), directed into the cold air discharge duct 40, and furnished through the cold air outlet ports 42 into the space separated by the shelves 24. The cold air is blown towards the front end of the chamber at a given offset angle with respect to the side wall of the refrigerator, and streams along arrows shown in FIG. 5, finally gets to the cold air inlet ports 43, from where it returns to the suction port 3B through said duct connected with the evaporator 43. It should be noted that such simple arrangement of the evaporator in inclination allows the air, returning from the cold air inlet port 43, to smoothly flow transversely from the cold air suction port 3B to the cold air outlet port 3A, establishing a laminar flow through the fins.

The arrangement of the inclined evaporator 34 also helps minimize the height thereof. Minimization of the height is desirable in that the height of the freezer chamber 2 may accordingly be made smaller, yet maintaining a flatter lower surface of the partition member 9. Such flatter surface is desirable in avoiding possible bumping of goods placed on the uppermost shelf against the non-flat portion of the lower surface of the partition member when the shelf is rotated.

Referring now to FIGS. 7 through 10, the refrigeration chamber 10 has corner space at opposite corners not usable by the round shelves 25. The space may be utilized, however, by a cold air supply duct 48 for furnishing cold air to the storage chamber including the refrigeration chamber 10 and the ice-temperature compartment 17. The cold air supply duct 48 extend vertically along the opposite corners, respectively, and, at their upper ends, communicates with the cold air discharge duct 40. A damper 54 having baffles 52 and 53 is provided in the cold air supply duct 48 for closing/opening the cold air outlet port 50 and 51, respectively. The cold air duct 48 contains two passages: one 55 for use with the refrigeration chamber and another 56 for the ice-temperature compartment 17. The baffle 53 is disposed in the passage 56. The passage 55 is provided with a plurality of cold air outlet ports 45 corresponding to the respective spaces divided by the shelves 25. Deodorization means 60 such as ozone generator 58 or ozone dissociation catalyst may be mounted in the passage 56 for the ice-temperature compartment.

That portion of the cold air streaming downward from the cold air discharge duct 40 smoothly flows through the communication portion 49 into the cold air supply duct 48. The damper 54, driven by a single electric motor 61, is adapted to close or open the baffles 52 and 53 in accordance with the temperatures of the refrigeration chamber 10 and the ice-temperature compartment 17. That portion of the cold air that exits from the outlet 50 into the cold air supply duct 48 is furnished to the refrigeration chamber 10 from the outlet port 45. That portion of the cold air that exits from the outlet 51 is furnished from the lower end of the cold air supply duct 48 to the ice-temperature compartment 17 and then to the vegetable preservation compartment 18. The amount of the cold air provided to the chamber 10 and the compartment 17 may be adjusted by the damper 54 to maintain the chamber 10 and the compartment at respective predetermined temperatures in the redetermined temperatures in the range of −1° to −3° C.

Figure 12:
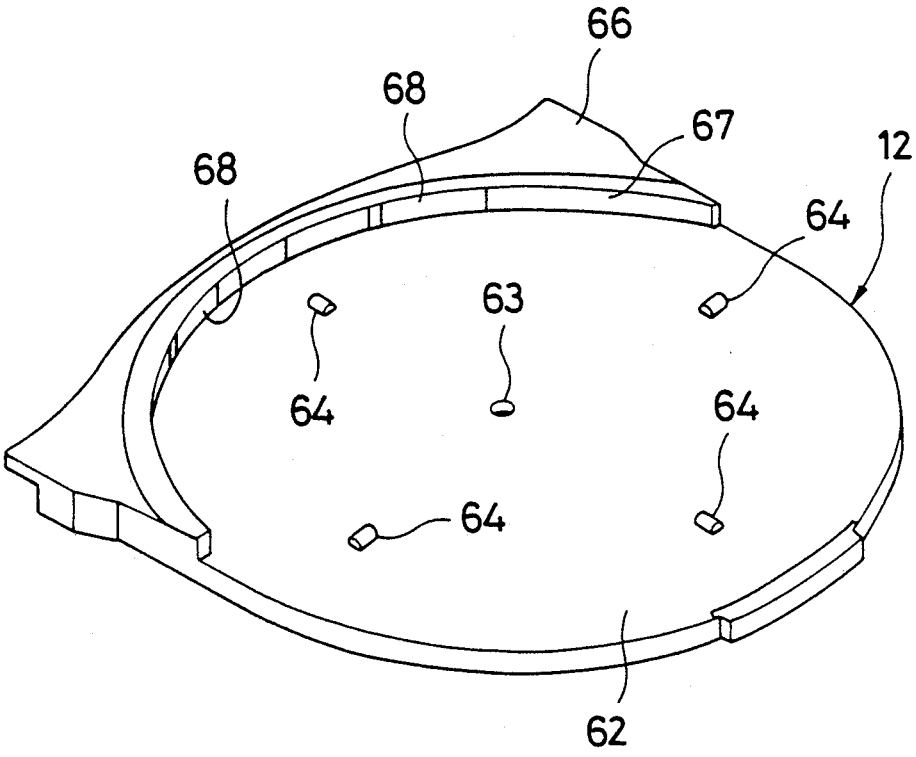
FIG. 12 is a perspective rear view of a partition board for use with a refrigerator embodying the invention.

The partition board 12 located above the container 15 is provided with a round recess 62 for receiving a shelf 27, which board bears thereon a shaft bearing 63 and rollers 64 for rotatably supporting the shelf 27. As shown in FIG. 12, the partition board 12 has a heaped front portion 66 having a vertical arcuate back wall which is offset a little from the edge of the board 27. A multiplicity of holes 68 are formed in the arcuate back wall, from which holes 68 the cold air furnished to the ice-temperature compartment 17 and the vegetable preservation compartment 18 returns to the refrigeration chamber 10. The heaped portion 66 has approximately the same height as the shelf 27 so that it hides the front edge of the shelf 27 and the holes 68 as well.

Figure 11:
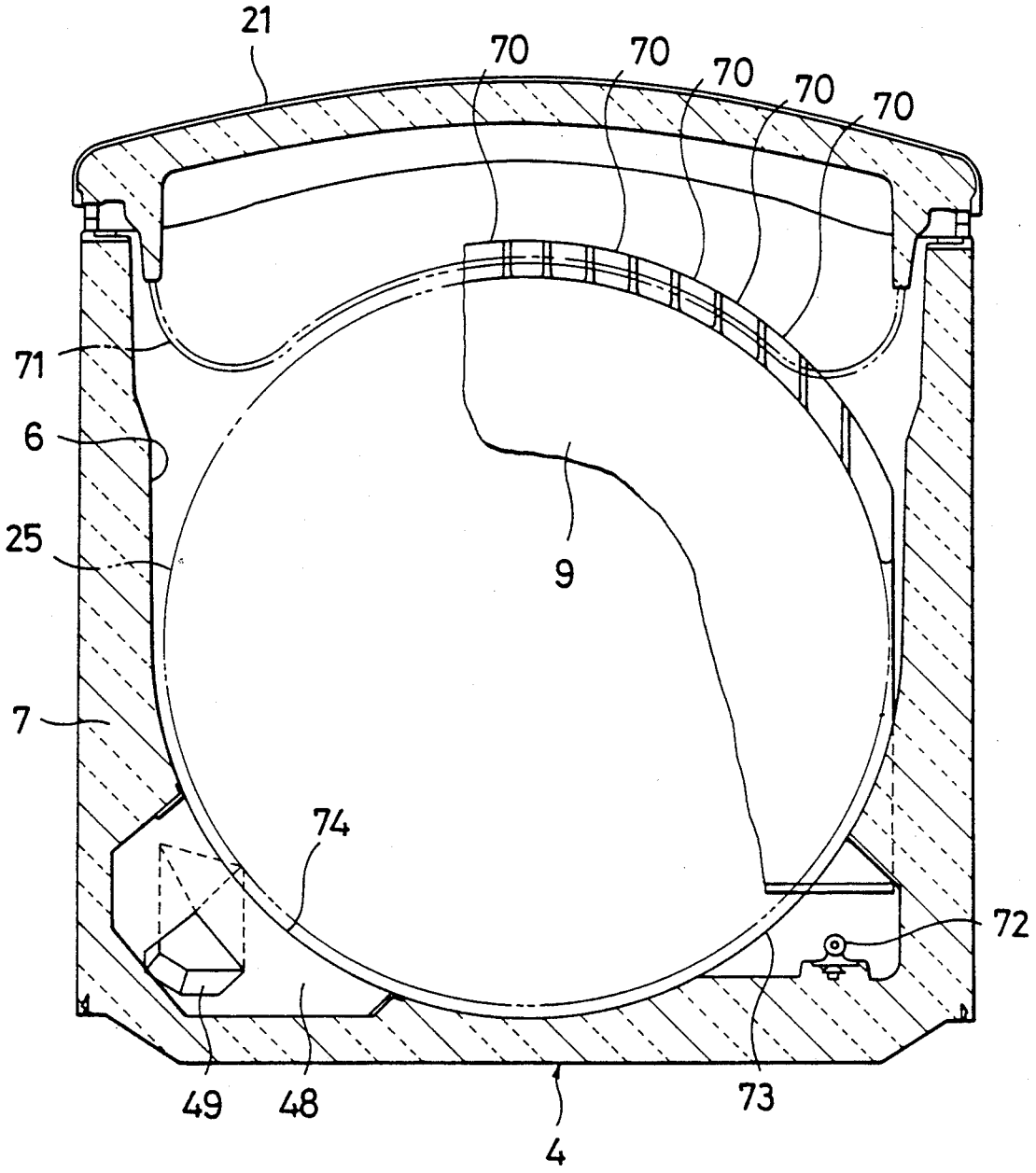
FIG. 11 is a cross section taken along A—A of FIG. 2.

In the front lower portion of the partition member 9 are provided, as shown in FIG. 11, a multiplicity of peripheral air suction ports 70. The cold air taken into these holes passes through a cold air return channel 46 formed inside a molded thermal insulator 8, the cold air suction port 3B, and to the return port 47, from where the air returns to the suction port of the evaporator 34. Since the suction ports 70 are arcuately lined along the outer periphery of the shelf 25, they may smoothly intake the air that has flown from the holes 68 in the arcuate back wall into the refrigeration chamber 10 as well as the air that has diffused from the lower portion of the refrigeration chamber 10 through the gap between the shelves 25 and the arcuate door 21.

Pockets 71 are provided on the inner surface of the door 21. The pockets 71 are formed to extend toward the shelves 25 and have arcuate outlines extending along the front edges of the shelves 25. A in-chamber lamp 72 is provided at a corner opposite to the corner having the air duct 48. The lamp 72 is installed at an intermediate level of the refrigeration chamber, and oriented slightly downwardly. A white curved cover 73 made of a polystyrene resin mixed with light scattering agent covers the lamp 72 for diffusing the light of the lamp in all directions, thereby illuminating throughout the refrigeration chamber. A duct cover 74 covers the cold air supply duct 48.

As described above, rotatable shelves 25 provided in the refrigeration chamber 10 provide great convenience for the user to reach for any article placed on the shelves. A cold air supply duct 48 in a rear corner of the refrigeration chamber 10 and of a lamp 72 in the other rear corner permits the use of large round shelves extending deeply to the refrigeration chamber, and hence gives increased inner space of the refrigerator while maintaining or decreasing the depth of the entire refrigerator, thereby adding further usability to the refrigerator.

Arcuate door pockets efficiently utilize otherwise dead space formed between the inner box and the round shelves, providing merits of a square refrigerator and of easy-to-use rotatable shelves. Furthermore, the storage chamber in the refrigerator may be illuminated favorably by employing vertical lamp shade without disturbing the rotational motion of the rotatable shelves.

We claim:

1. A refrigerator comprising:

a storage chamber having a ceiling wall, side walls and a bottom wall, all of which are composed of thermal insulator;

at least one cold air outlet for providing cold air to the storage chamber is provided in one of said walls;

shelves rotatably supported in horizontal plane are settled in the storage chamber for putting goods thereon to be stored in said refrigerator; and a cold air passage being formed at a corner space between the junction of side walls and the outer peripheries of said shelves providing cold air to said storage chamber through said air outlet.

2. A refrigerator as recited in claim 1, wherein said cold air passage is provided in one corner space formed at the rear of said storage chamber; and said chamber has at least one lamp at the other rear corner of said chamber.

3. A refrigerator as recited in claim 1, wherein doors for shutting the front opening of said storage chamber have some door pockets on the inside of said door and these door pockets are extending to the front corner space of said storage chamber.

4. A refrigerator as recited in claim 3, wherein the inner surfaces of said doors are curved and projecting forward; and the surfaces of said door pockets facing said shelves have contours that extend along the edges of said shelves.

5. A refrigerator comprising:

a storage chamber having a ceiling wall, side walls and a bottom wall, all of which are composed of thermal insulator;

at least one cold air outlet for providing cold air to the storage chamber is provided in one of said walls;

shelves rotatably supported in horizontal plane are settled in the storage chamber for putting goods thereon to be stored in said refrigerator; and a cold air passage being formed at a corner space between the junction of side walls and the outer peripheries of said shelves providing cold air to said storage chamber through said air outlet; and a heat exchanger of a refrigerating unit for supplying cooling air to the storage chamber is mounted at the back side of said rear storage chamber in inclination to the vertical line.

6. A refrigerator as recited in claim 5, wherein said shelves are formed in the shape of circular discs and mounted on said walls so as to horizontally partition said storage chamber into a multiplicity of spaces; and each of said partitioned spaces is provided with said cold air outlet.

7. A refrigerator as recited in claim 6, wherein said shelves are configured to extend outwardly of the front edges of said walls;

doors for said storage chamber are each mounted on one of said walls, with the inside of said doors being curved to extend forward.

8. A refrigerator as recited in claim 7, further comprising:

a partition member for partitioning said storage chamber into upper and lower partitioned spaces, said partition member having a curved front edge extending forward beyond the front edges of said walls.

9. A refrigerator as recited in claim 7, wherein the front edges of said partition member includes flat end portions and a central curved portion having an a specified radius of curvature;

said doors each have on the thereof a seal member that may abut on said front edge of said partition member; and portions of said doors that face the portions of the partition member connecting said central curved portion with said flat end portions, have approximately the same contour as the contour of said front edge of the partition member.

* * * * *